US006640346B2

(12) United States Patent
Dufresne

(10) Patent No.: US 6,640,346 B2
(45) Date of Patent: Nov. 4, 2003

(54) VISOR PROTECTOR

(76) Inventor: Henri Dufresne, 90 Rivard, Repentigny (CA), J5Y 2C5

( * ) Notice: Subject to any disclaimer, the term of this patent is extended or adjusted under 35 U.S.C. 154(b) by 0 days.

(21) Appl. No.: 10/068,976

(22) Filed: Feb. 11, 2002

(65) Prior Publication Data

US 2002/0148033 A1 Oct. 17, 2002

Related U.S. Application Data

(63) Continuation-in-part of application No. 09/833,714, filed on Apr. 13, 2001, now abandoned.

(51) Int. Cl.[7] ..... A42B 1/08
(52) U.S. Cl. ..... 2/424; 2/422
(58) Field of Search ..... 2/424, 422, 15, 2/10

(56) References Cited

U.S. PATENT DOCUMENTS

| | | | |
|---|---|---|---|
| 4,625,341 | A | 12/1986 | Broersma |
| 4,651,356 | A | 3/1987 | Zide |
| 4,860,389 | A | 8/1989 | Morin |
| 5,014,486 | A | 5/1991 | Mayle |
| 5,185,889 | A | 2/1993 | Kamata |
| 5,213,241 | A | 5/1993 | Dewar et al. |
| 5,293,649 | A | 3/1994 | Corpus |
| 5,502,843 | A | 4/1996 | Strickland |
| 5,652,964 | A | 8/1997 | Reinheardt |
| 5,671,483 | A | 9/1997 | Reuber |
| 5,685,022 | A | 11/1997 | Essman et al. |
| 5,687,427 | A | 11/1997 | Lamattina et al. |
| 5,694,650 | A | 12/1997 | Hong |
| 5,878,443 | A | 3/1999 | Seiler |
| 5,893,174 | A | 4/1999 | Primeau |

*Primary Examiner*—John J. Calvert
*Assistant Examiner*—James G. Smith
(74) *Attorney, Agent, or Firm*—Francois Martineau

(57) ABSTRACT

A visor protector prevents a visor secured to a helmet from being scratched when not in use such as during transportation thereof. The protector includes a protective member that essentially covers at least the external surface of the visor. The protective cover is biased in pressuring configuration against the visor by stretchable straps secured to the protective member and releasably attaching to the helmet in stretched configuration. Preferably, the protective member includes an internal shell to simultaneously cover the internal surface of the visor and to form a transversal V-shaped cross-section of the protective member for slidably receiving the visor therein.

20 Claims, 4 Drawing Sheets

VISOR PROTECTOR

CROSS-REFERENCE TO RELATED APPLICATION

This application is a Continuation-In-Part (C.I.P.) of application Ser. No. 09/833,714 filed Apr. 13, 2001, now abandoned.

FIELD OF THE INVENTION

The present invention relates to visor protectors and more specifically to a protector that prevents a visor of a helmet from being scratched, in particular when the latter is not being used.

BACKGROUND OF THE INVENTION

It is common for hockey players to be required to wear protectors such as helmets including a transparent or translucent visor and it is quite unpleasant to play with a helmet which visor has been scratched. Usually, a player carries his helmet inside his sport bag along with multiple other pieces of equipment that could eventually damage the visor, it would therefore be advisable for the player to be able to protect his visor against possible wears. For that reason a user may be forced to buy a new visor that is quite expensive. Therefore preventing these visors from being scratched is very important. The same situation is applicable to different helmets of the type used, for example, by cyclists or by snowmobile drivers and the like cap visors.

U.S. Pat. No. 5,003,639 granted to White on Nov. 20, 1989 discloses a cap visor protector consisting of a flexible sheet of soil resistant or washable material having ends and lateral sides which is folded over the periphery of the sun protective visor and the material includes fastening cords attached to clips which are releasably affixed to the edges of the visor adjacent the cap head strap.

The limitation of the prior art is that the protector can be moved or even thrown off by other equipment and cannot prevent the visor from being scratched because of its non-effective securing position on the visor. User should to pay attention for not throwing off or loosing that protector by inadvertence or the like.

U.S. Pat. No. 5,213,241 granted to Dewar et al. on May 25, 1993 discloses a ski goggle protective device used to protect the goggle from being scratched when not being used and when carried around the wearer's arm or the like. Since the protective device is covering the goggle alone, it needs to firmly attach to the latter so as not to constantly fall off therefrom. Accordingly, the attachment mechanism either directly attaches to the goggle or needs to form a sort of bag to wrap the goggle therein, rather than only rely on applying a biasing force against the goggle.

Similarly, U.S. Pat. No. 5,878,443 granted to Seiler on Mar. 9, 1999 discloses convertible protective cover (or case or pocket) for a stand-alone mask that is substantially carried therewith that forms a sort of bag to wrap the mask therein, rather than only rely on solely applying a biasing force against the mask when protecting it.

These sort of bags or the like would not be applicable and useful when the visor is secured to a helmet or the like where its access is quite limited.

SUMMARY OF THE INVENTION

It is therefore a general object of the present invention to provide an improved visor protector that obviates the above-mentioned disadvantages.

An advantage of the present invention is that the proposed visor protector prevents the visor from being scratched during transportation.

A further advantage of the present invention is that the proposed visor protector can be adapted to different kind of helmets, so as to be essentially universal.

Still another advantage of the present invention is that the proposed visor protector is especially suited for hockey players' helmets.

Still a further advantage of the present invention is that the proposed visor protector is substantially inexpensive to manufacture.

According to the present invention, there is provided a visor protector for protecting a visor attached to a helmet when being unused, the visor defining a visor external surface and an opposed visor internal surface, the visor external and internal surfaces generally facing outwardly and inwardly relative to the helmet, the visor external and internal surfaces defining a common visor main edge and a generally opposed common visor attaching edge, the visor attaching edge attaching to the helmet, the visor protector comprises:

a generally elongated protective member including a protective external shell being configured and sized for substantially entirely overlying the visor external surface, the protective external shell defining an external shell main edge and a pair of generally opposed external shell longitudinal side edges adjacent the external shell main edge; and a protector attaching means for releasably attaching the protective member to the helmet when the protective external shell overlies the visor external surface, the protector attaching means being configured and sized for biasing the protective external shell in pressurizing configuration against the visor external surface.

Typically, the protector attaching means includes at least one elongated strap, the strap defining a strap first end and a generally opposed strap second end, the strap first end attaching to the protective external shell and the strap second end releasably attaching to the helmet.

Preferably, the protector attaching means includes a pair elongated stretchable straps, each of the stretchable straps defining a strap first end and a generally opposed strap second end, the strap first ends attaching to the protective external shell adjacent a respective one of the external shell side edges, the strap second ends releasably attaching to the helmet, the stretchable straps biasing the protective external shell in pressurizing configuration against the visor external surface when in stretched configuration.

Typically, the strap second ends attach to each other so as to have the stretchable straps longitudinally extending from each other, the stretchable straps attaching to the helmet by releasably embracing the helmet to bias the protective external shell in pressurizing configuration against the visor external surface when in stretched configuration.

Preferably, the visor main edge is a generally free edge, the protective member includes:

a protective internal shell for at least partially covering the visor internal surface, the protective internal shell defining an internal shell main edge, the internal shell main edge longitudinally extending adjacent the external shell main edge;

a shell connecting means for connecting the internal shell main edge to the external shell main edge so as to form a transversal V-shaped cross-section of the protective member for receiving the visor free edge therein when the protective external shell overlies the visor external surface.

Typically, the protective internal shell integrally extends from the protective external shell and longitudinally folds over along a fold line, the fold line forming both the internal shell main edge and the external shell main edge.

Preferably, the shell connecting means includes at least one seam longitudinally oriented along the fold line for stitching the external and internal parts together.

Optionally, the protective internal shell defines a pair of generally opposed internal shell longitudinal side edges adjacent the internal shell main edge, the internal shell side edges at least partially and longitudinally extending adjacent the external shell side edges and connecting thereto, the shell connecting means includes at least one main seam longitudinally oriented along the fold line and at least one side seam oriented along one of the internal shell side edges for stitching the protective external and internal shells to each other.

Preferably, the protector attaching means includes a fastener slidably mounted on each of the stretchable straps adjacent the strap second ends to slidably adjust its position therealong and for attaching to the helmet.

Preferably, the protector attaching means further includes an extension stretchable strap, the extension stretchable strap defining two opposed strap free ends, a pair of snap devices slidably mounted on the extension stretchable strap adjacent a respective one of the strap free ends, the snap devices being complementary to the fasteners of the pair of stretchable straps.

Typically, the protector attaching means further includes a pair of snap devices for securing to the helmet, the snap devices being complementary to the fasteners to releasably receive the fasteners thereon so as to attach the protector to the helmet.

Alternatively, the helmet defines a plurality of vent openings thereon, each of the fasteners includes a hook for anchoring to a respective one of the vent openings of the helmet.

Alternatively, the shell connecting means is a first part of a hook-and-loop type fastener secured to the protective external shell for attaching to a complementary second part of the hook-and-loop type fastener secured to the protective external shell.

Preferably, the protective external shell further defines an external shell auxiliary edge generally opposite to the external shell main edge, the protector attaching means further includes a third elongated stretchable strap, the third stretchable strap defining a third strap first end and a generally opposed third strap second end, the third strap first end attaching to the protective external shell adjacent the external shell auxiliary edge, the third strap second end releasably attaching to the helmet, the third stretchable strap biasing the protective external shell in pressurizing configuration against the visor external surface and the visor free edge inside the transversal V-shaped cross-section of the protective member when in stretched configuration.

Alternatively, the fastener of the third stretchable strap includes a hook for anchoring to a rear edge of the helmet.

Alternatively, the protective internal and external shells are made out of a resilient rigid type material. Typically, the protective internal shell further defines an internal shell auxiliary edge opposite to the internal shell main edge, the protective internal shell defining a concave portion longitudinally extending adjacent the internal shell auxiliary edge, the concave portion substantially abutting the protective external shell adjacent the external shell auxiliary edge, the fold line forming a hinge type connecting means for enabling the protective member to resiliently clamp on the visor with the concave portion of the protective internal shell resiliently abutting against the visor internal surface.

Preferably, the protective external and internal shells respectively define an external and an internal shell inner surface, the external and internal shell inner surfaces for facing the visor external and internal surfaces, respectively, the external and internal shell inner surfaces being covered with a felt type material for minimizing scratches on the visor external and internal surfaces Other objects and advantages of the present invention will become apparent from a careful reading of the detailed description provided herein, with appropriate reference to the accompanying drawings.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purposes and by no means as of limitation.

Figure 1:
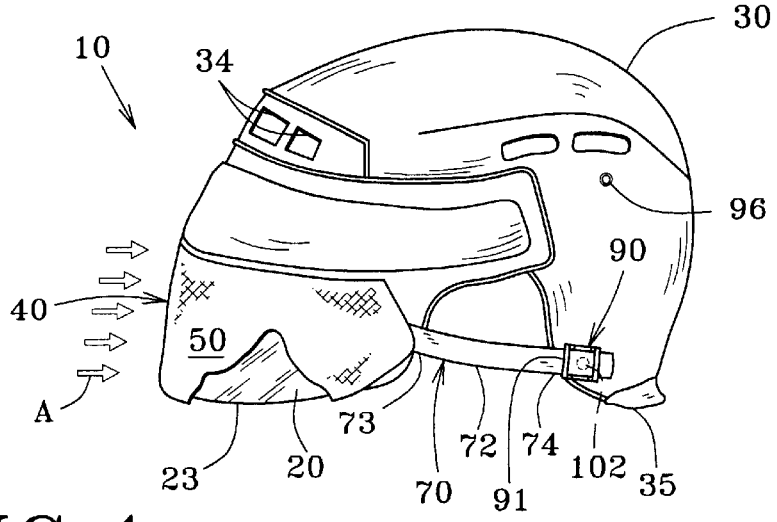
FIG. 1 is a side view of an embodiment of a visor protector according to the present invention overlaid on the visor of a helmet.
Figure 1A:
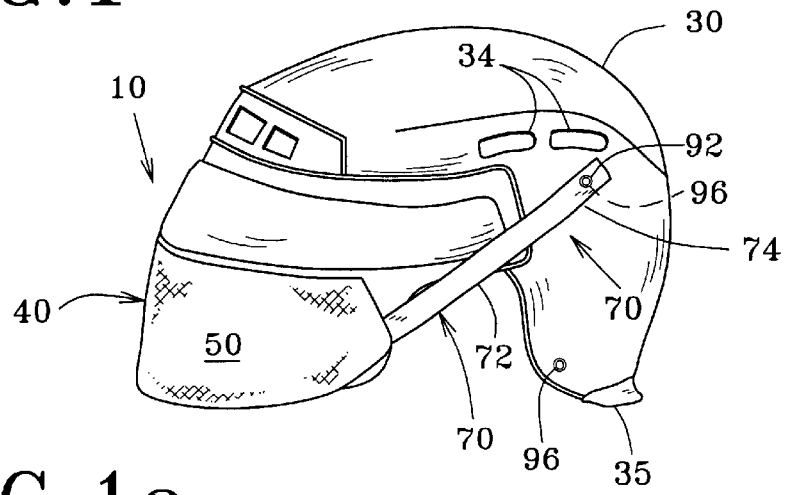
FIG. 1*a* is a view similar to FIG. 1, showing the protector attaching means secured to another possible attaching location on the helmet.

Referring to FIG. 1, there is shown an embodiment 10 of a visor protector according to the present invention for preventing a visor 20 attached to a helmet 30 from being scratched when unused.

The visor 20 defines a visor external surface 21 and an opposed visor internal surface 22, generally facing outwardly and inwardly relative to the helmet 30, respectively. The visor external 21 and internal 22 surfaces define a common visor main edge 23, generally free, and a generally opposed common visor attaching edge 24. The latter attaches to the helmet 30.

The visor protector 10 includes a generally elongated protective member 40 that includes a protective external shell 50, preferably flexible, configured and sized to substantially entirely overlie the visor external surface 21. The protective external shell 50 defines an external shell main edge 51, a generally opposed external shell auxiliary edge 52 and a pair of generally opposed external shell longitudinal side edges 53, 54 adjacent the external shell main edge 51.

The visor protector 10 also includes a protector attaching means to releasably attach the protective member 40 to the helmet 30 when the protective external shell 50 overlies the visor external surface 21. The protector attaching means 70 is configured and sized to bias the protective external shell 50 in pressurizing configuration against the visor external surface 21, illustrated by arrows A.

The protector attaching means 70 preferably includes a pair elongated stretchable straps 72, each defining a strap first end 73 and a generally opposed strap second end 74. The strap first ends 73 attach to the protective external shell 50 preferably adjacent a respective external shell side edge 53, 54. The strap second ends 74 releasably attach to the helmet 30. The stretchable straps 72 bias the protective external shell 50 in the pressurizing configuration against the visor external surface 21 when in stretched configuration.

Typically, the protector attaching means 70 includes a fastener 90 slidably mounted on each strap 70 adjacent the strap second ends 74 to attach to the helmet 30. Preferably, each fastener 90 includes a base 91 with a snap 92 located thereon, as better illustrated in FIG. 4. The base 91 of the fastener 90 allows adjustment of the position of the fastener 90 along the strap 72. The fastener snap 92 is adapted to releasably interconnect with complementary snap devices 96 secured to the helmet 30. Although the snap devices 96 are preferably part of the protector attachment means 70, they are usually found already installed in place as parts of the helmets 30 such as helmets for hockey.

Figure 4:
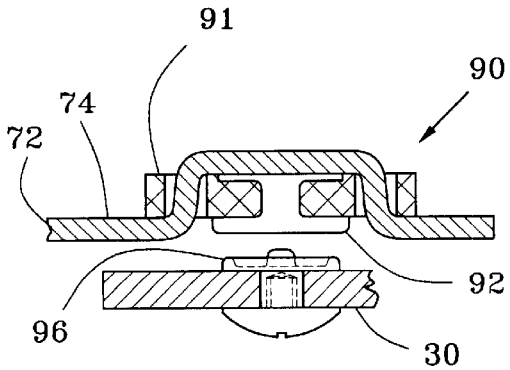
FIG. 4 is a section view taken along line 4—4 of FIG. 3.
Figure 7:
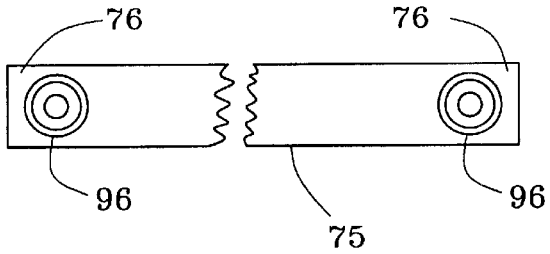
FIG. 7 is a broken view of the extension strap of FIG. 2.
Figure 7A:
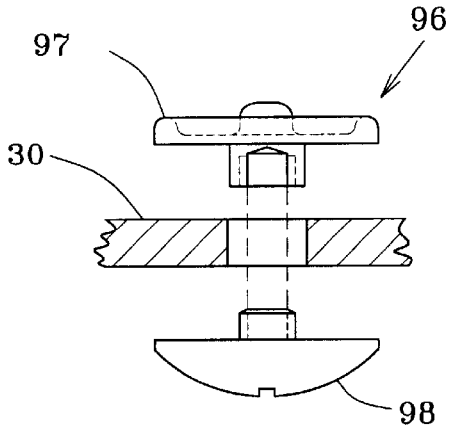
FIG. 7*a* is an exploded side view of a different snap device.

Each snap device 96, as illustrated in FIGS. 4 and 7*a*, preferably includes a button 97 for complementary engagement with the fastener snap 92 and a stud 98 for securing the button 97 to the helmet 30.

Figure 5:
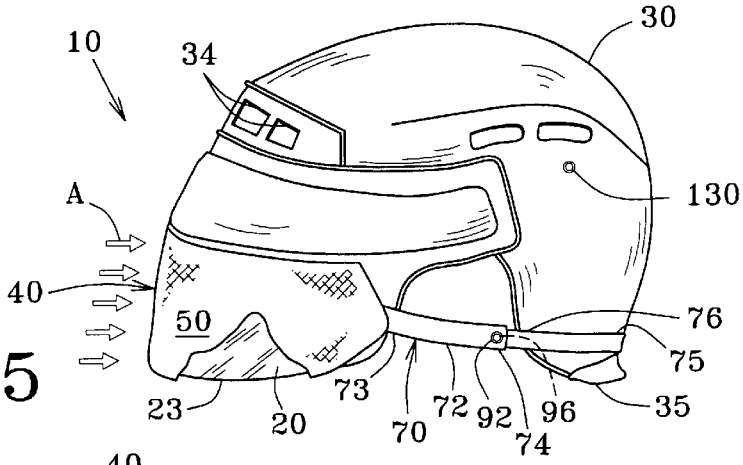
FIG. 5 is a view similar to FIG. 1, showing the protector attaching means including an extension strap.

Especially for cases where no snap devices 96 are present on the helmet 30, the protector attaching means 70 further includes an extension stretchable strap 75, as shown in FIGS. 5 and 7. The extension stretchable strap 75 defines two opposed strap free ends 76, each having a snap device 96 slidably mounted thereon adjacent a respective strap free end 76. Accordingly, each extension strap free end 76 attaches to a respective second end 74 of the pair of straps 72 so as releasably embrace the helmet 30 to bias the protective external shell 50 in the pressurizing configuration against the visor external surface 21 when in stretched configuration.

Figure 2:
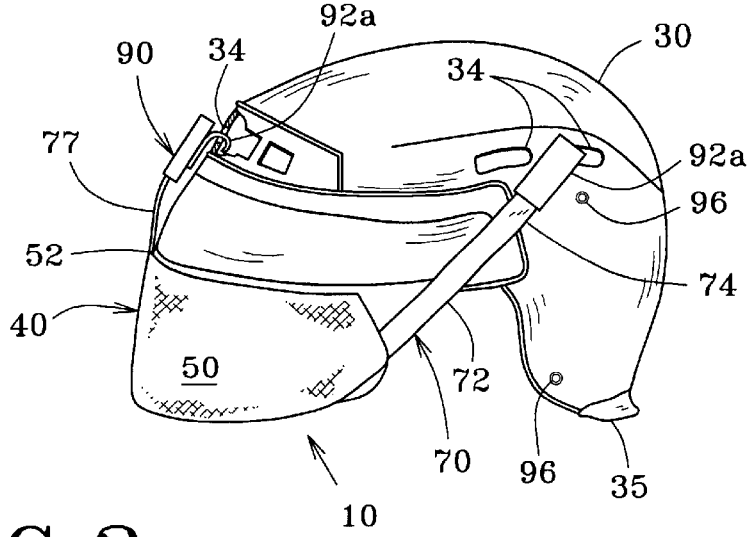
FIG. 2 is a view similar to FIG. 1, showing the protector attaching means including a third elongated strap.
Figure 3:
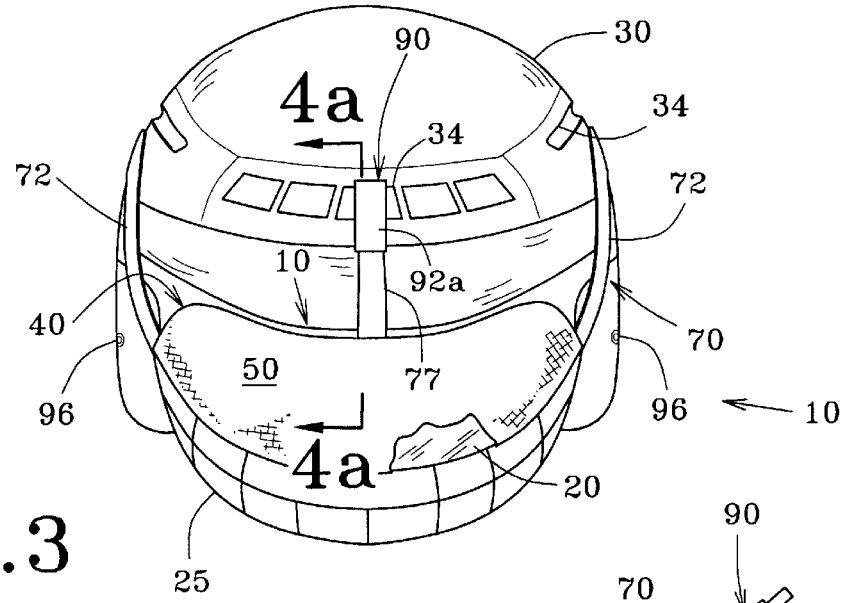
FIG. 3 is a front view of another embodiment of a visor protector according to the present invention overlaid on the visor having a lower wire shield section integrated therewith.

Usually, the different types of helmets 30 a plurality of vent openings 34 located thereon. As illustrated in FIGS. 2 and 3, the fastener 90 could also be a hook 92*a* adapted to anchor to a respective vent opening 34.

The fastener 90 could also be a first part of a hook-and-loop type fastener (not shown) for attaching to a complementary second part of the hook-and-loop type fastener (not shown) secured to the helmet 30.

In most helmets 30 known in the art, the visor main edge 21 is a generally free edge.

Figure 4A:
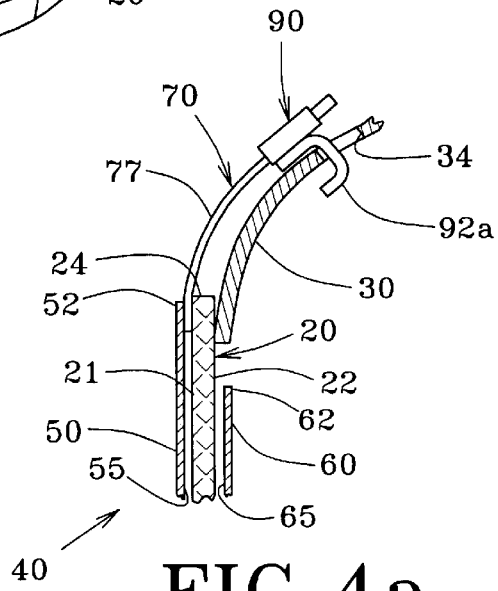
FIG. 4*a* is a section view taken along line 4*a*—4*a* of FIG. 3*a;*
Figure 6:
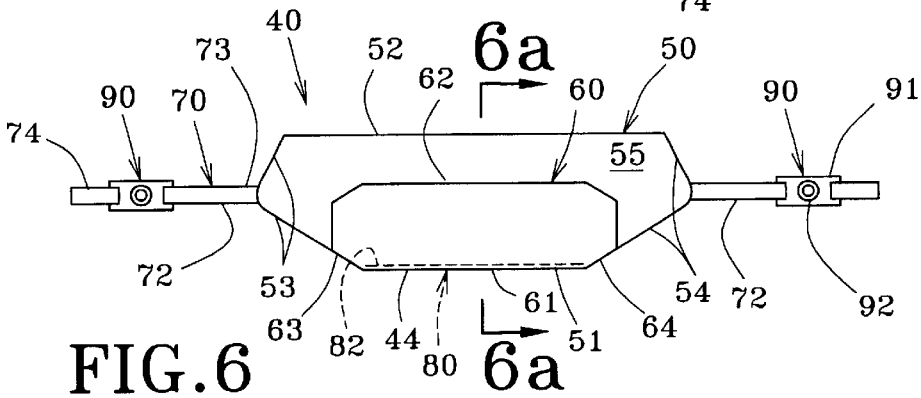
FIG. 6 is a back view of another embodiment of a visor protector according to the present invention, illustrating a protective member having protective external and internal shells.

Preferably, the protective member 40 of a second embodiment 10*a* of a visor protector according to the present invention shown in FIG. 6 further includes a protective internal shell 60, preferably flexible, for at least partially covering the visor internal surface 22 as partially illustrated in FIG. 4*a*. The protective internal shell 60 defines an internal shell main edge 61 longitudinally extending adjacent the external shell main edge 51, a generally opposed internal shell auxiliary edge 62 and a pair of generally opposed internal shell longitudinal side edges 63, 64 adjacent the internal shell main edge 61.

The protective member 40 also includes a shell connecting means 80 for connecting the internal shell main edge 51 to the external shell main edge 61 so as to form a transversal V-shaped cross-section 42 of the protective member 40 adapted to receive the visor free edge 23 therein when the protective external shell 50 overlies the visor external surface 21.

Figure 6A:
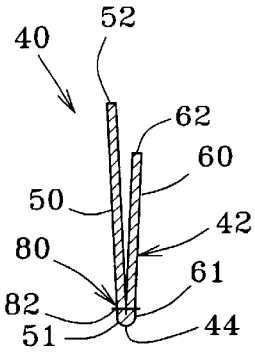
FIG. 6*a* is a section view taken along line 6*a*—6*a* of FIG. 6.

Preferably, as illustrated in FIGS. 6 and 6*a*, the protective internal shell 60 integrally extends from the protective external shell 50 and longitudinally folds over along a fold line 44, as part of the shell connecting means 80. The fold line 44 essentially forms both internal shell main edge 61 and external shell main edge 51. The shell connecting means preferably includes a stitch line 82 extending along the fold line 44 to reinforce the latter and to ensure that the protective member 40 keeps its transversal V-shaped cross-section 42.

Figure 8:
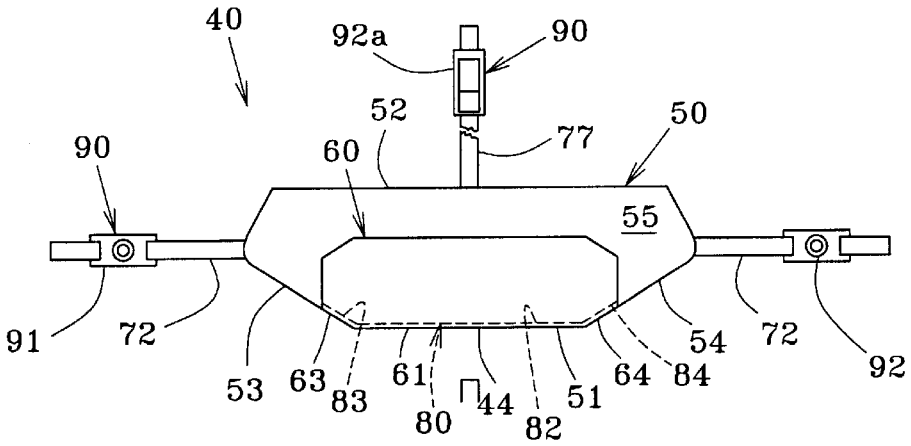
FIG. 8 is a back view similar to FIG. 6, showing the addition of a third elongated strap.

As shown in FIG. 8, the internal shell side edges 63, 64 at least partially and longitudinally extend adjacent the external shell side edges 53, 54 and partially connect thereto. The shell connecting means 80 further includes at least one, preferably two side stitch lines 83, 84 oriented along the internal shell side edges 63, 64 to further stitch the protective external 50 and internal 60 shells to each other.

Figure 6B:
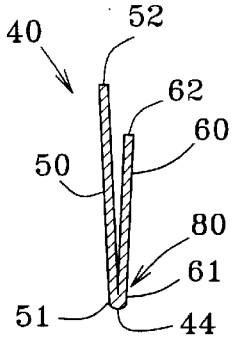
FIGS. 6*b,* 6*c,* 6*d,* 6*e,* 6*f,* 6*g* and 6*h* are section views similar to FIG. 6*a,* showing different embodiments of the shell connecting means.
Figure 6C:
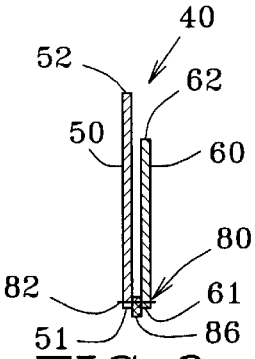
Figure 6D:
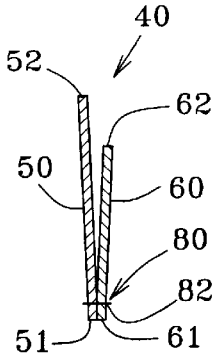
Figure 6E:
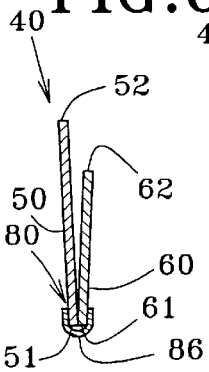
Figure 6F:
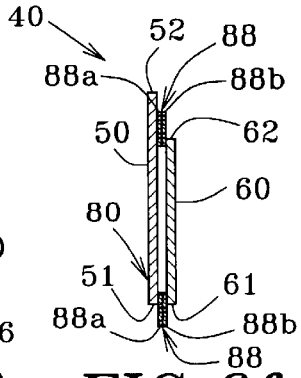
Figure 6G:
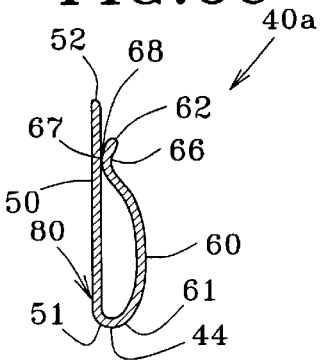
Figure 6H:
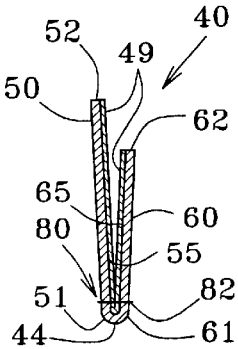

FIGS. 6*a* through 6*h* show alternate shell connecting means 80 used to obtain the transversal V-shaped cross-section 42. With semi-rigid type material used for both the protective external 40 and internal 60 shells, the protective member 40 could be simply pre-shaped as illustrated in FIGS. 6*b* and 6*g*. Only stitches 82, 83, 84 could be considered to connect the two protective external 40 and internal 60 shells together, as shown in FIGS. 6*d* and 6*h*. As illustrated in FIGS. 6*c* and 6*e*, a reinforcing elongated connecting piece 86 could also be used at the external 51 and internal 61 shell main edges.

Figure 9:
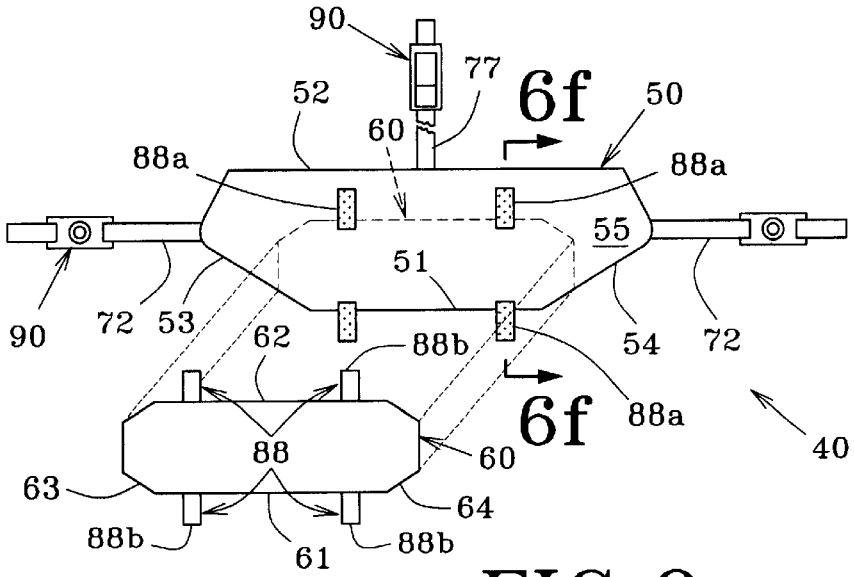
FIG. 9 is an exploded back view similar to FIG. 8, showing the embodiment of FIG. 3 with the protective internal shell detachable from the protective external shell.

For the embodiment depicted in FIGS. 6*f* and 9, due to a lower wire shield section 25 integrated to the visor 20 and extending form its main edge 23 as shown in FIG. 3, the protective external 50 and internal 60 shells are preferably releasably connected to each other to ease the installation of the protector 10 on the visor 20. Accordingly, the shell connecting means 80 preferably includes complementary parts 88*a*, 88*b* of a hook-and-loop type fastener 88 or the like secured to the respective protective external 50 and internal 60 shells.

As shown in FIGS. 2, 2*a*, 3, 4*a*, 8 and 9, the protector attaching means 70 further includes a third elongated stretchable strap 77. The third stretchable strap 77 defines a third strap first end 78 and a generally opposed third strap second end 79. The third strap first end 78 preferably attaches to the protective external shell 50 adjacent the external shell auxiliary edge 52, and the third strap second end 79 releasably attaches to the helmet 30. The third stretchable strap 77 biases the protective external shell 50 in pressurizing configuration against the visor external surface 21 and the visor free edge 23 inside the transversal V-shaped cross-section 42 of the protective member 40 when it is in stretched configuration.

Figure 2A:
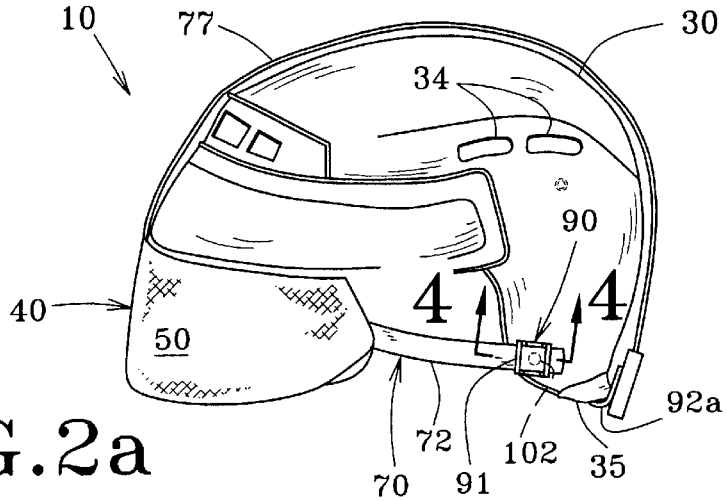
FIG. 2*a* is a view similar to FIG. 2, showing the third strap in another possible attaching location on the helmet.

Similarly to the pair of straps 72, the third strap 77 preferably includes a fastener 90 slidably mounted thereon adjacent the third strap second end 79 for attachment to the helmet 30. Referring to FIG. 2*a,* the fastener 90 is preferably a hook 92*a* adapted for anchoring to a rear edge 35 of the helmet 30.

In another embodiment illustrated in FIG. 6*g,* the protective internal 60 and external 50 shells are made out of a resilient rigid type material such as thermo-plastics or the like.

Accordingly, the protective internal shell 60 defines a concave portion 66 longitudinally extending adjacent the internal shell auxiliary edge 62. The apex region 67 of the concave portion 66 substantially resiliently abuts the protective external shell 50 adjacent the external shell auxiliary edge 52 so as to form a receiving mouth 68 of the transversal V-shaped cross-section 42 for receiving the visor free edge 23 therein. The fold line 44 essentially forms a hinge type connecting means 80 to enable the protective member 40 to resiliently clamp on the visor 20 with the concave portion 66 of the protective internal shell 60 resiliently abutting against the visor internal surface 22.

The protective external 50 and internal 60 shells respectively define an external 55 and an internal 65 shell inner surface for facing the visor external 21 and internal 22 surfaces, respectively. The external 55 and internal 65 shell inner surfaces are preferably covered with a felt type material 49 as illustrated in FIG. 6*h* to minimize scratches on the visor external 21 and internal 22 surfaces, when the protective member 40 in place protecting the visor 20.

For the embodiment 10 with only the protective external shell 50, the external shell inner surface 55 preferably provides for a frictional contact with the visor external surface 21 to prevent sliding off the protective member 40 therefrom, such as provided by rubber or leather type materials.

The visor protector 10 of the present invention can be made out of different types of leather or the like cloth type materials, such as transparent or translucent materials.

The straps 72, 75 and 77 are preferably made out of an elastic type material.

In use, the visor protector 10 is placed over the visor 20 so as to cover the same preferably within the protective member 40 that specifically covers the visor external surface 21 with its protective external shell 50 and the visor internal surface 22 with its protective internal shell 60. The protector attaching means 70 is attached to the helmet 30 with the visor 20 preferably being in its closed (or in-use) position. In that position, it is substantially impossible for the visor protector 10 to fall off from the visor 20, thus protecting the latter from being scratched by any object that can potentially get in contact with the helmet 30. Decorations or advertising may be readily applied to the protector 10, if required.

Although the present visor protector has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A visor protector for protecting a visor attached to a helmet when being unused, said visor defining a visor external surface and an opposed visor internal surface, said visor external and internal surfaces generally facing outwardly and inwardly relative to said helmet, said visor external and internal surfaces defining a common visor main edge and a generally opposed common visor attaching edge, said visor attaching edge attaching to said helmet, said visor protector comprising:

a generally elongated protective member including a protective external shell being configured and sized for substantially entirely overlying said visor external surface, said protective external shell defining an external shell main edge and a pair of generally opposed external shell longitudinal side edges adjacent said external shell main edge; and a protector attaching means for releasably attaching said protective member to said helmet when said protective external shell overlies said visor external surface, said protector attaching means being configured and sized for biasing said protective external shell in pressurizing configuration against said visor external surface.

2. The protector of claim 1, wherein said protector attaching means includes at least one elongated strap, said strap defining a strap first end and a generally opposed strap second end, said strap first end attaching to said protective external shell and said strap second end releasably attaching to said helmet.

3. The protector of claim 1, wherein said protector attaching means includes a pair elongated stretchable straps, each of said stretchable straps defining a strap first end and a generally opposed strap second end, said strap first ends attaching to said protective external shell adjacent a respective one of said external shell side edges, said strap second ends releasably attaching to said helmet, said stretchable straps biasing said protective external shell in pressurizing configuration against said visor external surface when in stretched configuration.

4. The protector of claim 3, wherein said strap second ends attach to each other so as to have said stretchable straps longitudinally extending from each other, said stretchable straps attaching to said helmet by releasably embracing said helmet to bias said protective external shell in pressurizing configuration against said visor external surface when in stretched configuration.

5. The protector of claim 1, wherein said visor main edge is a generally free edge, said protective member includes:

a protective internal shell for at least partially covering said visor internal surface, said protective internal shell defining an internal shell main edge, said internal shell main edge longitudinally extending adjacent said external shell main edge;

a shell connecting means for connecting said internal shell main edge to said external shell main edge so as to form a transversal V-shaped cross-section of said protective member for receiving said visor free edge therein when said protective external shell overlies said visor external surface.

6. The protector of claim 5, wherein said protective internal shell integrally extends from said protective external shell and longitudinally folds over along a fold line, said fold line forming both said internal shell main edge and said external shell main edge.

7. The protector of claim 6, wherein said shell connecting means includes at least one seam longitudinally oriented along said fold line for stitching said external and internal parts together.

8. The protector of claim 6, wherein said protective internal shell defines a pair of generally opposed internal shell longitudinal side edges adjacent said internal shell main edge, said internal shell side edges at least partially and longitudinally extending adjacent said external shell side edges and connecting thereto, said shell connecting means includes at least one main seam longitudinally oriented along said fold line and at least one side seam oriented along one of said internal shell side edges for stitching said protective external and internal shells to each other.

9. The protector of claim 3, wherein said protector attaching means includes a fastener slidably mounted on each of said stretchable straps adjacent said strap second ends to slidably adjust its position therealong and for attaching to said helmet.

10. The protector of claim 9, wherein said protector attaching means further includes an extension stretchable strap, said extension stretchable strap defining two opposed strap free ends, a pair of snap devices slidably mounted on said extension stretchable strap adjacent a respective one of said strap free ends, said snap devices being complementary to said fasteners of said pair of stretchable straps.

11. The protector of claim 9, wherein said protector attaching means further includes a pair of snap devices for securing to said helmet, said snap devices being complementary to said fasteners to releasably receive said fasteners thereon so as to attach said protector to said helmet.

12. The protector of claim 9, wherein said helmet defines a plurality of vent openings thereon, each of said fasteners includes a hook for anchoring to a respective one of said vent openings of said helmet.

13. The protector of claim 5, wherein said shell connecting means is a first part of a hook-and-loop type fastener secured to said protective external shell for attaching to a complementary second part of said hook-and-loop type fastener secured to said protective external shell.

14. The protector of claim 5, wherein said protector attaching means includes a pair elongated stretchable straps, each of said stretchable straps defining a strap first end and a generally opposed strap second end, said strap first ends attaching to said protective external shell adjacent a respective one of said external shell side edges, said strap second ends releasably attaching to said helmet, said stretchable straps biasing said protective external shell in pressurizing configuration against said visor external surface when in stretched configuration.

15. The protector of claim 14, wherein said protective external shell further defines an external shell auxiliary edge generally opposite to said external shell main edge, said protector attaching means further includes a third elongated stretchable strap, said third stretchable strap defining a third strap first end and a generally opposed third strap second end, said third strap first end attaching to said protective external shell adjacent said external shell auxiliary edge, said third strap second end releasably attaching to said helmet, said third stretchable strap biasing said protective external shell in pressurizing configuration against said visor external surface and said visor free edge inside said transversal V-shaped cross-section of said protective member when in stretched configuration.

16. The protector of claim 15, wherein said protector attaching means includes a fastener slidably mounted on each of said stretchable straps adjacent said strap second ends to slidably adjust its position therealong and for attaching to said helmet.

17. The protector of claim 16, wherein said fastener of said third stretchable strap includes a hook for anchoring to a rear edge of said helmet.

18. The protector of claim 6, wherein said protective internal and external shells are made out of a resilient rigid type material.

19. The protector of claim 18, wherein said protective internal shell further defines an internal shell auxiliary edge opposite to said internal shell main edge, said protective internal shell defining a concave portion longitudinally extending adjacent said internal shell auxiliary edge, said concave portion substantially abutting said protective external shell adjacent said external shell auxiliary edge, said fold line forming a hinge type connecting means for enabling said protective member to resiliently clamp on said visor with said concave portion of said protective internal shell resiliently abutting against said visor internal surface.

20. The protector of claim 5, wherein said protective external and internal shells respectively define an external and an internal shell inner surface, said external and internal shell inner surfaces for facing said visor external and internal surfaces, respectively, said external and internal shell inner surfaces being covered with a felt type material for minimizing scratches on said visor external and internal surfaces.

* * * * *